US005120264A

United States Patent [19]

Van Engel

[11] Patent Number: 5,120,264

[45] Date of Patent: Jun. 9, 1992

[54] WOMEN'S BRA AND PANTY UNDERWEAR

[76] Inventor: Pearl E. Van Engel, 1760 Wisteria St., Wellington, Fla. 33414

[21] Appl. No.: 653,722

[22] Filed: Feb. 6, 1991

[51] Int. Cl.[5] ..... A41C 3/08

[52] U.S. Cl. ..... 450/7; 450/22; 450/69; 2/67; 2/73

[58] Field of Search ..... 2/73, 67, 109, 110; 450/1, 7, 15, 16, 22, 23, 27, 33, 68, 69, 80; 66/175, 176

[56] References Cited

U.S. PATENT DOCUMENTS

| | | | |
|---|---|---|---|
| 1,317,018 | 9/1919 | Kaye | 450/29 X |
| 1,486,779 | 3/1924 | Mayer | 450/7 |
| 1,487,670 | 3/1924 | Slikerman | 450/7 |
| 1,616,018 | 2/1927 | Winter | 450/16 |
| 1,792,180 | 2/1931 | Merckelbach | 450/22 |
| 1,840,937 | 1/1932 | Duff | 450/16 |
| 1,911,227 | 5/1933 | Galligan et al. | 2/67 |
| 2,249,198 | 7/1941 | Carter | 66/175 |
| 3,479,844 | 11/1969 | Silvain | 66/176 |
| 3,556,106 | 1/1971 | Rosner | 450/16 X |
| 4,983,140 | 1/1991 | Gimble | 450/7 |

FOREIGN PATENT DOCUMENTS

| | | | |
|---|---|---|---|
| 0001928 | 4/1927 | Australia | 450/16 |
| 0453463 | 12/1927 | Fed. Rep. of Germany | 450/16 |
| 324290 | 3/1903 | France | 450/16 |
| 715708 | 12/1931 | France | 450/7 |
| 49759 | 7/1939 | France | 2/67 |
| 49797 | 7/1939 | France | 2/67 |

*Primary Examiner*—Werner H. Schroeder
*Assistant Examiner*—Jeanette E. Chapman
*Attorney, Agent, or Firm*—Malin, Haley, McHale, DiMaggio & Crosby

[57] ABSTRACT

A women's undergarment that combines support for acting as a brassiere and underpants formed as a unitary garment made from nylon mesh fabric in one piece with a single flat seam at the back. A top band for breast support sized to fit around the upper torso of the female with a lower triangular shaped portion which is wider in the front and has a thong-like shaped panty in the rear portion of the garment where it is unitarily formed. The undergarment has no visible seams, straps, hooks or buttons and is totally functional and unrestricting for the wearer.

6 Claims, 2 Drawing Sheets 12
14

32
34
28a
28
30

36a
36
38
40
42
44

WOMEN'S BRA AND PANTY UNDERWEAR

BACKGROUND OF THE INVENTION

1. Field of the Invention

This invention relates to women's undergarments and in particular to an undergarment useful for both bust support and underpanties combined, and specifically to an undergarment that eliminates seams, straps and hooks.

2. Description of the Prior Art

In recent years styling dictates that for proper appearance, the seams, hooks and buttons found in underpants and brassieres be hidden or unobservable especially with tight-fitting clothes. Although pantyhose are worn which eliminates some seams, pantyhose are restrictive in that they have to be removed for performing bodily functions. In addition, separately, brassieres of varying weights and material have been used which often include hooks either in the front or the rear of the brassiere. The present invention overcomes these problems by providing a single undergarment which is not restrictive and has no seams, straps or hooks and yet provides both breast support and functions as underpants.

SUMMARY OF THE INVENTION

A unitary undergarment for a woman that includes a top breast supporting band sized to fit snuggly around the upper torso of the body, said band being constructed of a nylon knit/mesh material of sufficient denier preferrably 30, and a triangularly shaped panty panel extending across the lower front portion of the upper band, tapering to the crotch area and then connected to the back of the upper band with a thin tubular thong-like portion. The panty triangular is made of a nylon knit/-mesh fabric of a low denier preferrably 10 and may include a knitted cotton gusset.

The upper elastic knit/mesh fabric band need not be specially shaped or formed (such as a bra cup) for breast support, but may include elastic inter-knitted segments for enhanced bust support and may also include one side of a fabric fastener (known under the trademark of VELCRO) knitted into the band at the factory for use with enhancing pads with the other side of the fabric fastener in the bust areas. The lower panty panel and thong is sufficiently elastic due to its nylon mesh fabric construction (10 denier) to permit displacement sideways without removing the garment for performing body functions.

It is an object of this invention to provide an improved women's undergarment that functions as a unitary garment for breast support and as a panty or underwear that has no seams, straps, hooks or buttons and that can be comfortably worn in an unrestricted manner.

It is another object of this invention to provide a unitary women's undergarment for both bust support and panty underwear functions that can also function as lingerie without seams or buttons.

Still another object of this invention is to provide a women's undergarment that is unitary in construction from a nylon knit/mesh fabric material that functions for bust support and panty undergarment.

In accordance with these and other objects which will be apparent hereinafter, the instant invention will now be described with particular reference to the accompanying drawings.

PREFERRED EMBODIMENT OF THE INVENTION

Figure 1:
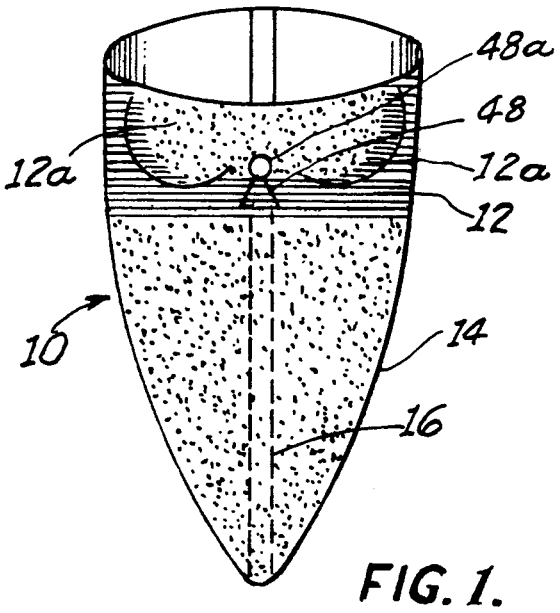
FIG. 1 shows a front elevational view of an undergarment in accordance with the present invention.
Figure 2:
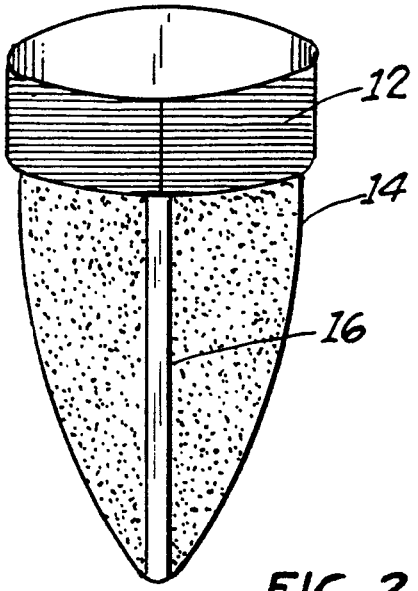
FIG. 2 shows a rear elevational view of the undergarment.

Referring now to FIG. 1, an undergarment shown generally at 10 in accordance with the invention is constructed of a nylon hosiery fabric band 12 of denier 30 with a ½" double knit edging band that encompasses the upper torso and covers the breast area 12*a*. The band 12 is unitarily attached to a front triangular panel 14 which forms the panty bottom which may be also made of a lightweight denier 10 knit/mesh fabric with a tube shaped thong-like rear portion 16 which attaches to the back bottom edge of the upper band 12. In FIG. 2 the thong portion 16 is shown attached to band 12. The garment shown in FIGS. 1 and 2 is unitary in construction and has no seams, buttons or hooks and yet the upper band is stretchable because of its nylon construction to comfortably support the breast acting as a brassiere while the bottom panel functions as a panty. The thong portion 16 and panty portion 14 can be moved sideways while being worn to perform body functions so that it does not have to be totally removed. Ties or strings 48 may be used to loop around the mid-portion top through hole 48*a*, for a configuration as in FIG. 5.

Figure 3:
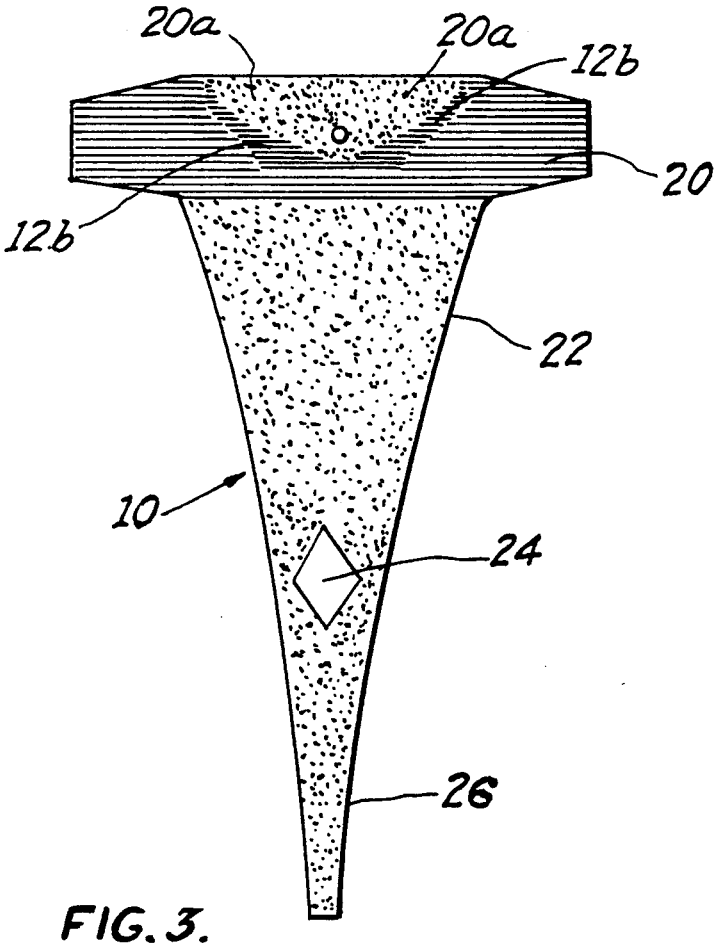
FIG. 3 shows an outside flat plan view of the undergarment with the panty panel and thong disconnected from the rear portion of the band.

Referring to FIG. 3 the garment 10 is shown with the upper band 20 in the front bust portion 20*a* with a 30 denier supporting portion 12*b* having elastic interwoven with the same knit/mesh nylon fabric. The panty panel 22 may include a cotton gusset 24 which acts as a cotton pad in the crotch area. The thong portion 26 would be attached to the rear lower edge of the upper band 20 as shown in FIGS. 1 and 2.

Figures 4, 5, 6, 7, 8:
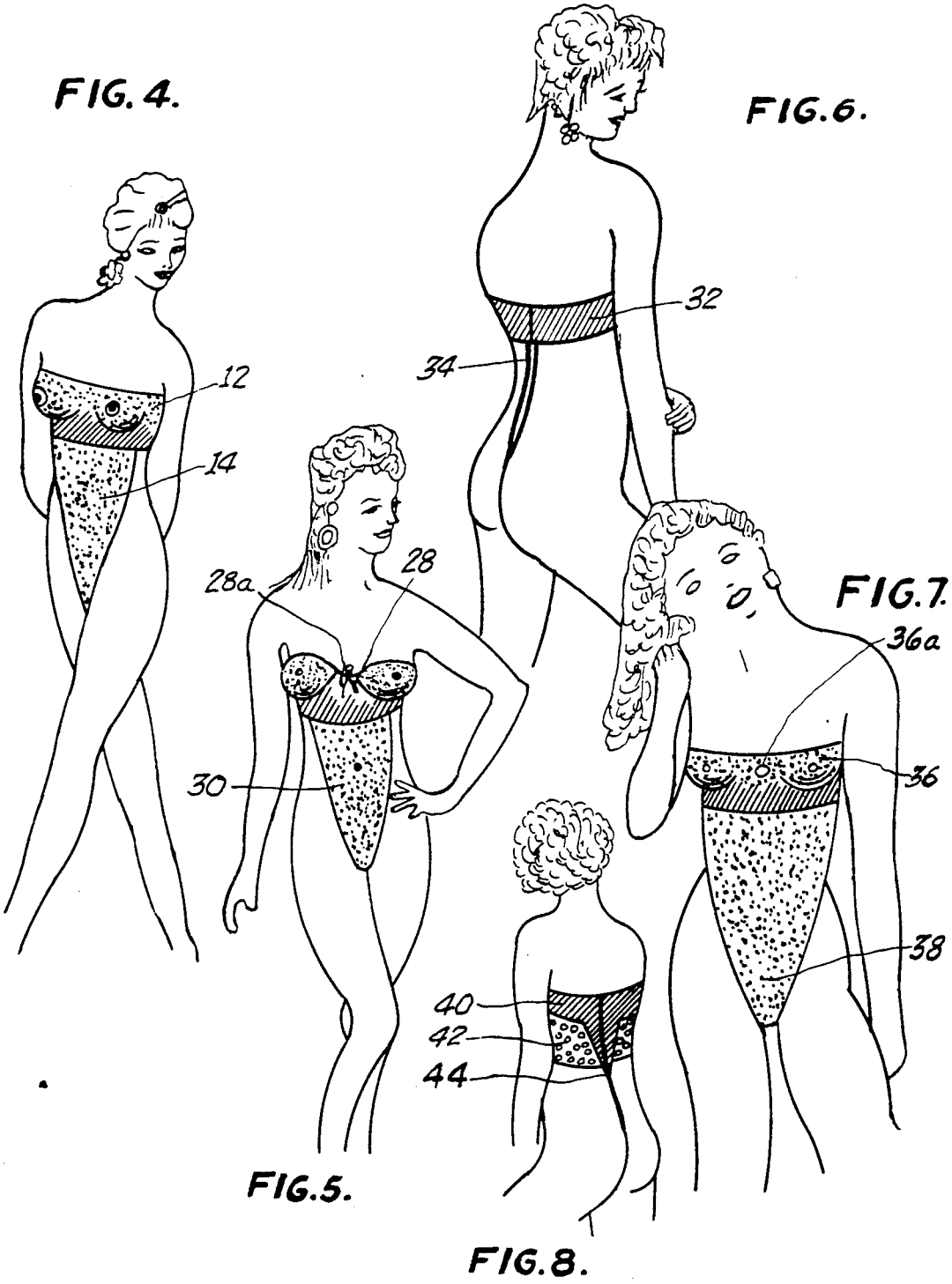
FIG. 4 shows a front perspective view of the garment as it is to be worn.
FIG. 5 shows a front perspective view of the garment with a front top tieing arrangement.
FIG. 6 shows a back perspective view of the garment.
FIG. 7 shows a front elevational view of the undergarment.
FIG. 8 shows a back perspective view of an alternate embodiment of the garment.

FIG. 4 shows the undergarment as it would be worn with the upper panel 12 disposed around the upper torso while supporting the breasts and the lower panty panel 14 unitarily attached thereto.

FIG. 5 shows an alternate embodiment with the upper panel 28 being lower in the center portion while still performing the bust supporting function, while maintaining the attached panty panel 30, using string ties 28*a* pulling the upper center downward.

FIG. 6 shows an upper nylon knit/mesh fabric panel 32 and a small tube shaped thong 34 attached to the lower rear portion of panel 32.

FIG. 7 shows an upper nylon knit/mesh fabric panel 36 with a wider panty panel 38 still tapering to the crotch area which may include a rear support panel as shown in FIG. 8. The thong area 44 is attached to the lower rear portion of the panel. Tie aperture 36*a* is shown.

In the upper panel shown for breast support an underbra cup can be knitted with elastic without causing any seams or need for hooks or button supports. The thong may consist of a three inch wide band sewn into a tube when the back seam is sewn up and attached to the center back area.

The undergarment may be knitted on a hosiery loom in one piece with a single flat seam at the back which is not visible when worn as an undergarment.

Thus the present invention provides a women's undergarment for both bust support and panty use that can be used conveniently and unrestrictedly without having any visible seams, buttons or hooks without restricting bodily functions in that the garment need not be removed by the wearer.

The instant invention has been shown and described herein in what it is considered to be the most practical and preferred embodiment. It is recognized, however, that departures may be made therefrom within the scope of the invention and that obvious modifications will occur to a person skilled in the art.

What I claim is:

1. A one piece woman's undergarment having a front and rear portion and being constructed of a nylon mesh fabric, a undergarment acting as a brassiere for a woman's breasts and underpants for a woman's crotch area, comprising:

an upper band portion having a upper band front and rear portion, said upper band portion annularly constructed of a nylon mesh fabric to fit around an upper torso and breasts of a wearer for breast support and a lower portion having a triangular shaped panty front panel of a nylon mesh fabric formed unitarily with and continuing downwardly from said upper band front portion to said crotch area, said lower portion having thong means formed unitarily with said triangular shaped panty front panel at said crotch area and continuing upwardly and attached to said upper band rear portion.

2. A woman's undergarment as in claim 1, wherein said upper band portion has a fabric denier different than said lower portion.

3. A woman's undergarment as in claim 1, wherein said undergarment has no buttons or visible seams or hooks.

4. A one piece woman's undergarment having a front and rear portion and being constructed of a nylon mesh fabric, said undergarment acting as a brassiere for a woman's breasts and underpants for a woman's crotch area, comprising:

an upper band portion having a upper band front and rear portion, said upper band portion annularly constructed of a nylon mesh fabric to fit around an upper torso and breasts of a wearer for breast support and a lower portion having a triangular shaped panty front panel of a nylon mesh fabric formed unitarily with and continuing downwardly from said upper band front portion to said crotch area, said lower portion having thong means formed unitarily with said triangular shaped panty front panel at said crotch area and continuing upwardly and attached to said upper band rear portion, said upper band portion having a fabric denier different that said lower portion.

5. A woman's undergarment as in claim 4, wherein said undergarment has no buttons or visible seams or hooks.

6. A one piece woman's undergarment having a front and rear portion and being constructed of a nylon mesh fabric, said undergarment acting as a brassiere for a woman's breasts and underpants for a woman's crotch area, comprising:

an upper band portion having a upper band front and rear portion, said upper band portion annularly constructed of a nylon mesh fabric to fit around an upper torso and breasts of a wearer for breast support and a lower portion having a triangular shaped panty front panel of a nylon mesh fabric formed unitarily with and continuing downwardly from said upper band front portion to said crotch area, said lower portion having thong means formed unitarily with said triangular shaped panty front panel at said crotch area and continuing upwardly and attached to said upper band rear portion, said upper band portion having a fabric denier different that said lower portion, said undergarment having no buttons or visible seams or hooks.

* * * * *